US008069770B1

(12) United States Patent
Martin et al.

(10) Patent No.: US 8,069,770 B1
(45) Date of Patent: Dec. 6, 2011

(54) MODULAR SPACED ARMOR ASSEMBLY

(75) Inventors: Curtis A. Martin, Damascus, MD (US); Bruce J. Wells, Middletown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 183 days.

(21) Appl. No.: 12/429,444

(22) Filed: Apr. 24, 2009

(51) Int. Cl.
*F41H 5/02* (2006.01)

(52) U.S. Cl. ..... 89/36.02; 89/36.07; 89/36.08; 89/36.09; 89/906; 428/911; 109/49.5

(58) Field of Classification Search ..... 89/36.02–36.12; 428/911; 109/49.5
See application file for complete search history.

(56) References Cited

U.S. PATENT DOCUMENTS

| | | | | |
|---|---|---|---|---|
| 4,398,446 | A | 8/1983 | Pagano et al. | |
| 4,529,640 | A | 7/1985 | Brown et al. | |
| 4,836,084 | A | 6/1989 | Vogelesang et al. | |
| 5,271,879 | A | 12/1993 | Saatchi et al. | |
| 5,469,773 | A | 11/1995 | Tarpinian | |
| 5,769,153 | A | 6/1998 | Ayers | |
| 5,814,250 | A | 9/1998 | Dudt et al. | |
| 5,972,819 | A | 10/1999 | Cohen | |
| 5,996,115 | A * | 12/1999 | Mazelsky | 2/2.5 |
| 6,009,789 | A | 1/2000 | Lyons | |
| 6,112,635 | A | 9/2000 | Cohen | |
| 6,314,858 | B1 | 11/2001 | Strasser et al. | |
| 6,860,186 | B2 | 3/2005 | Cohen | |
| 6,899,009 | B2 * | 5/2005 | Christiansen et al. | 89/36.02 |
| 7,322,267 | B1 * | 1/2008 | Munson, Jr. | 89/36.02 |
| 7,685,922 | B1 * | 3/2010 | Martin et al. | 89/36.02 |
| 7,799,710 | B1 * | 9/2010 | Tan | 442/221 |
| 2005/0066805 | A1 | 3/2005 | Park et al. | |
| 2005/0087064 | A1 | 4/2005 | Cohen | |
| 2009/0217812 | A1 * | 9/2009 | Whitaker et al. | 89/36.02 |
| 2010/0212486 | A1 * | 8/2010 | Kurtz et al. | 89/36.02 |
| 2010/0236393 | A1 * | 9/2010 | Martin et al. | 89/36.02 |
| 2010/0307327 | A1 * | 12/2010 | Gettle | 89/36.02 |

OTHER PUBLICATIONS

S.Nemat-Nasser, Damage Tolerant Lightweight Armor Materials; Army Reseach Lab;*Apr. 13, 2009; DTIC(http://www.dtic.mil/dtic/search/tr/index.html).

B.K. Fink et al. Application of Al Foam for Stress-Wave Mgmt in Ltweight Composite Integral Armor;*Apr. 13, 2009;Army Research Lab; DTIChttp://www.dtic.mil/dtic/search/tr/index.html.

C.T. Sun et al., Lightweight Layered Materials/Structures for Damage Tolerant Armor; *Apr. 13, 2009; US Army Research Office; DTIC(http://www.dtic.mil/dtic/search/tr/index.html).

M.S. Thomspon, Evaluation of Structural Porous Metals; M.L. Renauld, Dept of Navy-ONR; *Apr. 13, 2009; DTIC (http://www.dtic.mil/dtic/search/tr/index.html).

* cited by examiner

*Primary Examiner* — Michael David
(74) *Attorney, Agent, or Firm* — Dave A. Ghatt

(57) ABSTRACT

A method and device for protecting a surface. The device includes modular spaced armor assemblies having a ceramic face plate, a composite backing plate, and a lightweight low-density module therebetween. The modular spaced armor assemblies may be tiled to form a protective arrangement for protecting a desired surface. The lightweight low-density module includes one or more gas filled cavities.

10 Claims, 4 Drawing Sheets

MODULAR SPACED ARMOR ASSEMBLY

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for protecting a surface, more particularly, a modular spaced armor assembly for covering a surface.

BACKGROUND

Armor used to protect vehicles, such as tanks or ships, is typically made of hardened steel material, heavy composite material, or sometimes ceramics. Typically, such armor adds considerable weight to the vehicle. Consequently, heavier more powerful engines are required to move the vehicle at the required speed. Moreover, the added weight reduces the payload capacity and effective range of the vehicle. Additionally, the considerable weight of the armor material makes retrofitting for armor, and servicing already-existing armor relatively difficult. Traditionally used armor is also not compatible with lightweight vehicles, which in order to be functional, require less cumbersome and lighter armor.

SUMMARY

In one aspect, the invention is a modular spaced armor assembly. In this aspect the invention includes a ceramic face plate, a composite backing plate, a lightweight low-density module between the ceramic face plate and the composite backing plate. According to the invention, the lightweight low-density module includes one or more gas-filled cavities. The gas is at least 30% of the volume of the lightweight low-density module.

In another aspect, the invention is a modular armored arrangement. In this aspect the invention includes a protected surface. The invention further includes a plurality of modular spaced armor assemblies positioned on the protected surface. Each modular spaced armor assembly has a ceramic face plate, a composite backing plate attached to the protected surface, and a lightweight low-density module between the ceramic face plate and the composite backing plate. In this aspect, the lightweight low-density module includes one or more gas-filled cavities.

In another aspect, the invention is a method of protecting a surface. The method includes the covering of the surface with a modular armored arrangement. The method also includes the providing of the modular armored arrangement with a plurality of interchangeable modular spaced armor assemblies. In this aspect, each of the plurality of modular spaced assemblies is provided with a first plate for receiving projectiles at an initial angle. Each of the plurality of modular spaced assemblies is also provided with a second plate for stopping projectiles that penetrate the first plate, wherein the projectiles strike the second plate at less effective striking angle. Each of the plurality of modular spaced assemblies is further provided with a lightweight low-density module between the first plate and the second plate for providing spacing between the first plate and the second plate. According to the method, the spacing allows projectiles that penetrate the first plate, the opportunity to redirect to the less effective striking angle.

BRIEF DESCRIPTION OF THE DRAWINGS

Other features will be apparent from the description, the drawings, and the claims.

DETAILED DESCRIPTION

Figure 1:
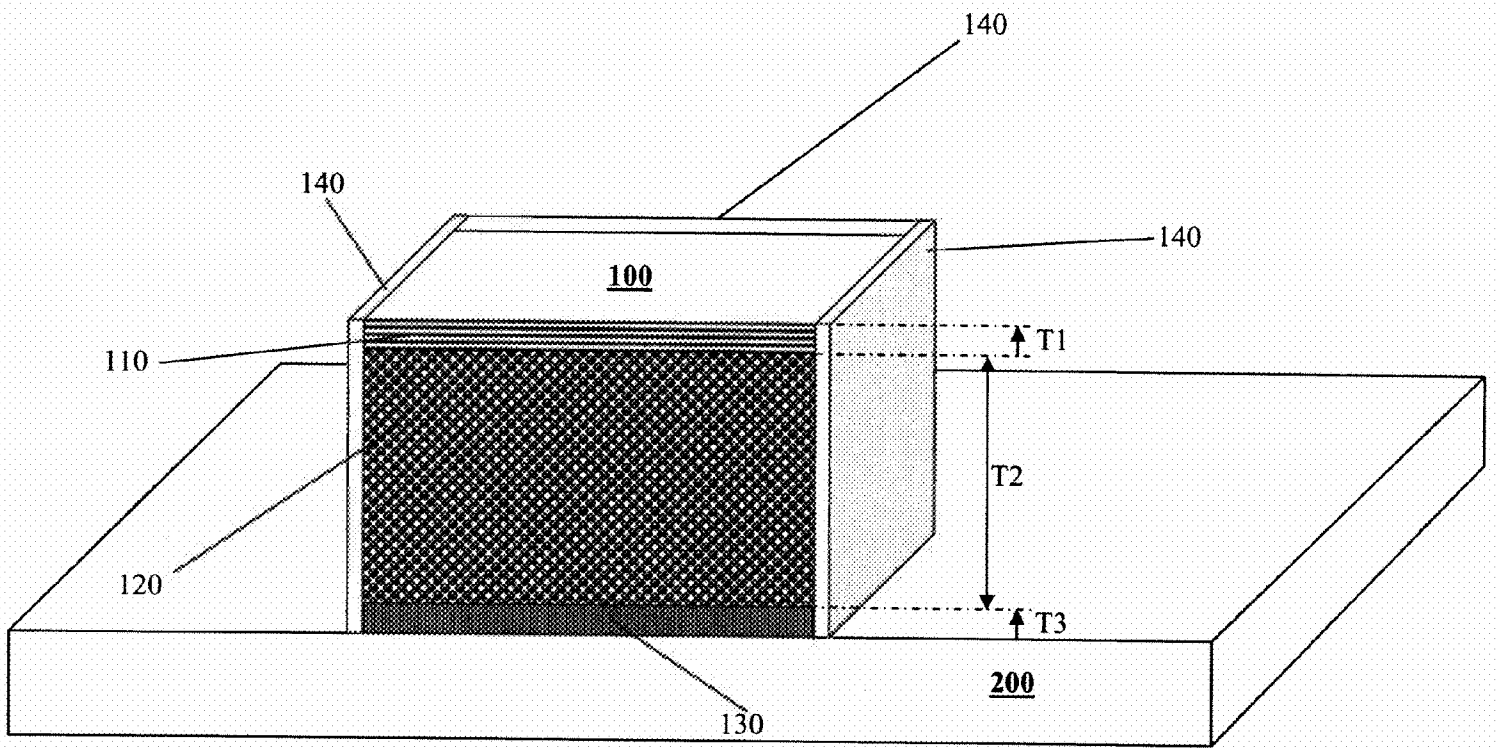
FIG. 1 is an exemplary sectional perspective illustration of a modular spaced armor assembly attached to a surface according to an embodiment of the invention.

FIG. 1 is an exemplary sectional perspective illustration of a modular spaced armor assembly 100 attached to a surface 200 according to an embodiment of the invention. As outlined below, the modular spaced armor assembly 100 is a multilayered structure that covers a surface 200 for shielding the surface 200 from explosives, projectiles, and the like. The surface 200 is any surface that is to be protected. According to an embodiment of the invention, the surface 200 is an external surface of a combat vehicle such as a tank, an armored car, an amphibious landing vehicle, a littoral combat ship, a patrol boat, a combat boat, or the like. The modular spaced armor assembly 100 may be attached to the surface 200 with attachment devices such as adhesives, mechanical clips, rails, and the like, and combinations thereof. According to an embodiment of the invention, in conjunction with the spaced armor assembly 100, the surface 200 may provide protection from projectiles and the like. Although the modular armor assembly 100 shown in FIG. 1 has a rectangular cross section, it should be noted that the assembly 100 may have any desired shape. For example the modular armor assembly 100 may be rectangular, triangular, pentagonal, hexagonal, octagonal, or irregular.

FIG. 1 shows the modular spaced armor assembly 100 having three different module sections 110, 120, and 130 arranged in a layered structure. The module sections 110, 120, and 130, may be bonded using adhesives such as urethanes, epoxies, or polysulfides. Additionally, other processes such as molding and laminating may be used to bond the module sections 110, 120, and 130. The module section 110 is the face plate of the armor assembly 100 and in operation is the first line of defense against a projectile or the like. According to an embodiment, the face plate 110 is hard ceramic material. The face plate 110 may be made from any suitable ceramic material that provides the desired hardness, such as boron carbide, silicon carbide, high purity aluminum oxide, mixed zirconium dioxide and aluminum oxide, titanium diboride, aluminum nitride, silicon nitride, sintered silicon carbide, sintered silicon nitride, or combinations thereof, as disclosed in U.S. Patent Application 2005/0066805 A 1, entitled "Hard Armor Composite" which is incorporated herein by reference for all that it discloses. Face plate 110 may be provided as graded or multi-layered ceramics, and may be developed by known processes such as by sequential centrifugal casting or by laminating tape-cast ceramic.

Module section 120 is lightweight and low-density, and is sandwiched between module sections 110 and 130, providing spacing between materials sections 110 and 130. The module section 120 has one or more gas filled cavities. According to an embodiment of the invention, the lightweight low-density module 120 is a foam material having gas filled cavities in which the gas may be from about 30% to about 90% of the lightweight low-density module 120. The foam material may be metallic, polymeric, ceramic, or combinations thereof. The foam materials are selected because they have a desired combination of minimized weight and maximized through-thickness stiffness. An example of metallic foam that may be employed is aluminum foam. The aluminum foam may be an open-cell or a closed-cell aluminum foam. Additionally, cell sizes and wall thicknesses may vary as desired.

According to an embodiment of the invention, the lightweight low-density module 120 may be a honeycomb structure having gas filled cavities in which the gas may be from about 30% to about 90% of the lightweight low-density module 120. The honeycomb structure also has a desired combination of minimized weight and maximized through-thickness stiffness. The honeycomb structure may have any cell geometry, such as hexagonal, square, and triangular, for example, and may have any desired wall thickness or bore size. Honeycomb materials may include ceramics, polymers, polymer composites, and metals. Commercially available versions include aluminum, steel, stainless steel, and fiberglass/epoxy composite.

According to an embodiment of the invention, the lightweight low-density module 120 may be entirely filled with gas. In this embodiment, the gas is housed within the modular spaced armor assembly 100 by module section 110 above, module section 130 below, and encapsulation plates 140 along the sides. In this embodiment, the encapsulation plates 140 may be thicker than in other embodiments because the plates 140 support the face plate 110. Regarding module section 120, weight and ballistic performance against a threat of interest will dictate the nature of the material.

Material section 130 is a composite backing plate, and may be formed from composite materials. In operation, the composite backing plate 130 is directly attached to the surface 200 that the modular spaced armor assembly 100 protects. The composite backing plate 130 may be formed from composites such as glass/polyester or glass/epoxy, or from metals such as steel or aluminum. The composite backing plate 130 may also be formed from polymer fiber boards. The composite backing plate 130 may be a ceramic matrix or a metal matrix, as disclosed in U.S. Patent Application 2005/0066805 A1, which as stated above, is incorporated herein by reference.

The composite backing plate 130 may be a layered structure, having for example, each layer formed from a different material or a different material combination. As stated above, in conjunction with the spaced armor assembly 100 the surface 200 may provide protection from projectiles and the like. The surface 200 may be made from metals such has hard steel, as well as other hard materials described above for plates 110 and 130.

FIG. 1 also shows one or more encapsulation plates 140, surrounding the module sections 110, 120, and 130, exposing only a top surface of the face plate 110 and a bottom surface of the backing plate 130. A single encapsulation plate 140 may be used as a continuous band around the layered arrangement of module sections 110, 120, and 130. Alternatively, a plurality of encapsulation plates 140 in an end-to-end arrangement may form a continuous band around the layered arrangement of the module sections 110, 120, and 130. In the sectional illustration of FIG. 1, the layered arrangement of module sections 110, 120, and 130 appears to be exposed because a face plate 140 is cut out of the figure. The encapsulation plate may be formed from metals such as aluminum or steel, or may be formed from a polymer matrix material. An encapsulation plate material may be selected so that an encapsulation plate 140 of one modular spaced armor assembly 100 adheres to an encapsulation plate 140 of another modular spaced armor assembly 100 by compressive forces, as discussed below. Although more than one encapsulation plates 140 are illustrated, any desired number of plates 140 may be used in each modular spaced armor assembly.

The sectional perspective illustration of FIG. 1 also shows module sections 110, 120, and 130 having respective thicknesses T1, T2, and T3. The ratios of the thicknesses among the materials 110, 120, and 130 are provided to optimize the protective capabilities of the modular spaced armor assembly 100. According to an embodiment of the invention, the ratio of the thickness T1 of the face plate 110 to the thickness T2 of the lightweight low-density intermediate module 120 is about 1 to 10 to about 1 to 25. According to this embodiment, the ratio of the thickness T1 of the face plate 110 to the thickness T3 of the backing plate 130 is about 1 to 1 to about 2 to 1. According to this embodiment, the ratio of the thickness T3 of the backing plate 130 to the thickness T2 of the lightweight low-density intermediate module 120 is about 1 to 20 to about 1 to 50. It should be noted that the relative dimensions and overall dimensions are selected based on combinations of materials, threat protection levels, and weight and volume limitations.

Figure 2B:
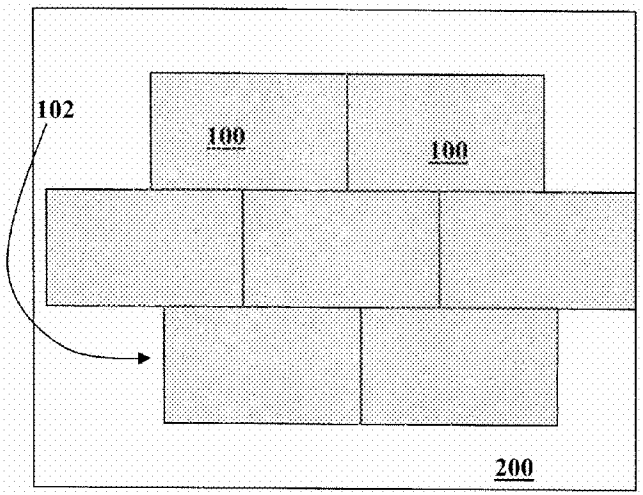
FIGS. 2A-2C are exemplary illustrations of modular armored arrangements on a protected surface, according to embodiments of the invention.
Figure 2A:
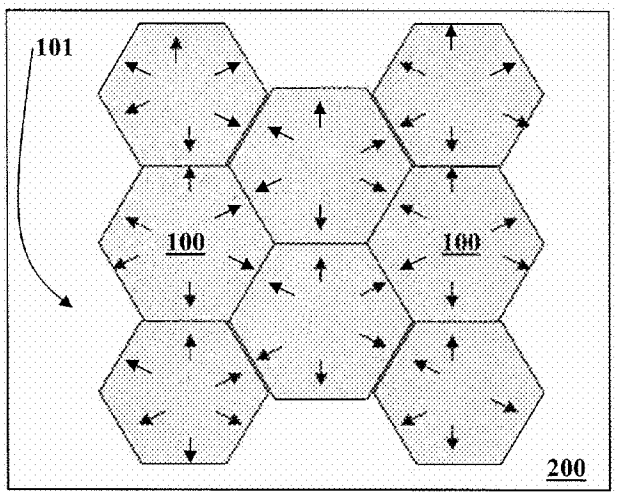
Figure 2C:
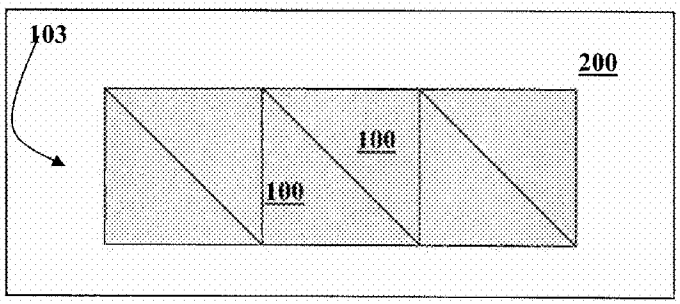

FIGS. 2A-2C are exemplary illustrations of modular armored arrangements 101, 102, and 103 respectively, on a protected surface 200, according to embodiments of the invention. The arrangements 101, 102, and 103 include a plurality of modular assemblies 100 arranged in a side-by-side manner on the surface 200, forming a tiled pattern. Thus, in the illustrated arrangements 101, 102, and 103, an encapsulation plate 140 of one assembly 100 abuts against an encapsulation plate 140 of another assembly 100. As outlined above, the surface 200 is any surface that is to be protected, and may be an external surface of a combat vehicle such as a tank, an armored car, an amphibious landing vehicle, a littoral combat ship, a patrol boat, a combat boat, or the like.

FIGS. 2A-2C show arrangements in which the modular armor assemblies 100 have pentagonal, rectangular, and triangular shapes respectively. In addition to the pentagonal, rectangular, and triangular armor arrangements, armor assemblies may be made from hexagonal assemblies, octagonal assemblies, irregular assemblies, as well as combinations of differently shaped assemblies. As outlined above, each modular spaced armor assembly 100 may be attached to the surface 200 with attachment devices such as adhesives, mechanical clips, rails, and the like, and combinations thereof.

As outlined above, encapsulation plate materials may be selected so that an encapsulation plate 140 of one modular spaced armor assembly 100 adheres to an encapsulation plate 140 of another modular spaced armor assembly 100. For example, an encapsulation plate material that is compressible, such as an elastic polymer, can provide a compression/clamping force between two abutting modules 100, when a compressed encapsulation plate 140 of one module abuts against a compressed encapsulation plate 140 of another module. The compression forces may thereby hold together arrangements as shown in FIGS. 2A-2C. FIG. 2A shows compressive forces, represented by arrows, acting to hold together the tiled arrangement 101. Although not illustrated, similar compressive forces may act in the other arrangements 102 and 103. Such compressive arrangements reduce the requirement for other attachment devices outlined above. However, attachment devices may be used in conjunction with the above-outlined compressive holding arrangement among modules 100. The arrangements 101, 102, 103, as shown, which include a plurality of modular assemblies 100, provide a single unified armor protection sheet over the surface. However, the arrangements also allows for the convenient replacement of individual modular assemblies at point locations where there is damage or where the armor arrangement has been compromised.

Figure 3:
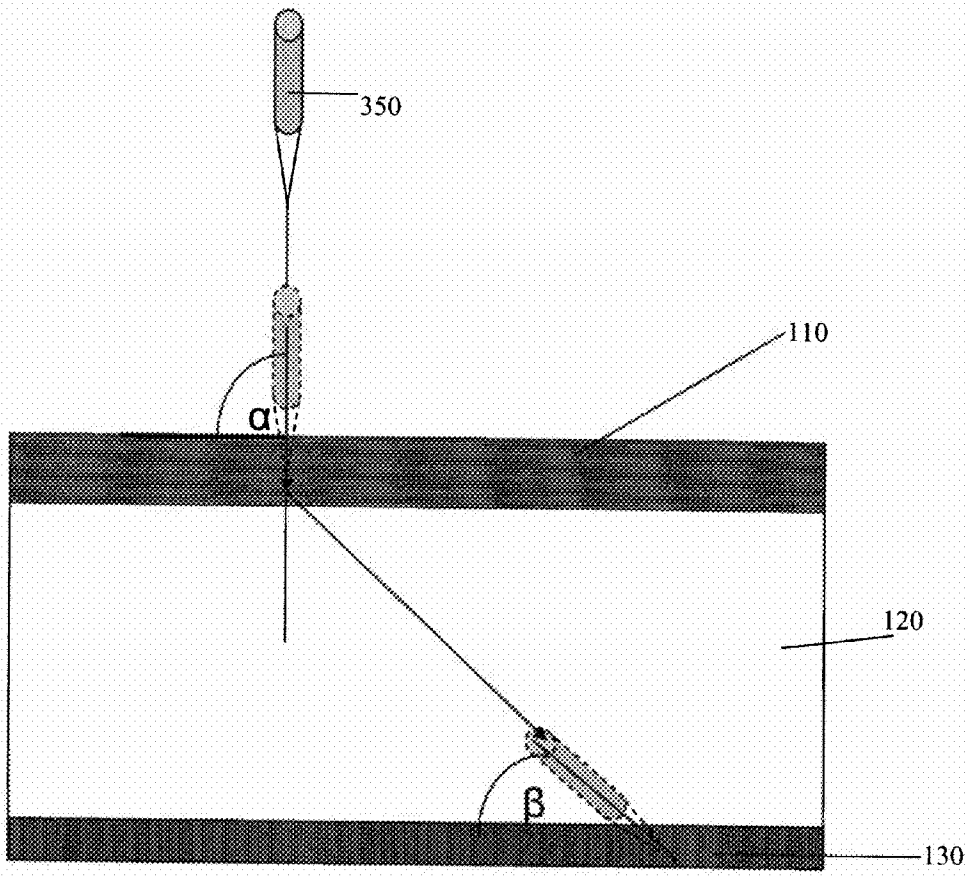
FIG. 3 is an exemplary schematic illustration, showing how a modular spaced armor assembly protects a surface, according to an embodiment of the invention.

FIG. 3 is an exemplary schematic illustration, showing how a modular spaced armor assembly 100 protects a surface 200, according to an embodiment of the invention. According to an embodiment, the face plate 110, the lightweight intermediate module 120, and the backing plate 130 combine to protect the surface 200 from projectiles and the like. As shown, a projectile 350 impinges on the face plate 110 at an initial angle $\alpha$ relative to the face plate surface. Because the face plate 110 is formed from a hard ceramic material, projectiles like projectile 350 may deflect and/or fragment upon contact with the surface. In addition to the possibility of fragmentation upon contact, projectiles like projectile 350 may also partially or wholly penetrate the face plate 110.

FIG. 3 shows the projectile 350 wholly penetrating the face plate 110. Projectiles like projectile 350 are more likely to penetrate the face plate 110 when striking the surface at an initial a angle of about 90°. Even though the projectile 350 is not stopped by the plate 110, the projectile loses kinetic energy as a consequence of the impact, and the speed of the projectile 350 is reduced. The lightweight low-density intermediate module 120 provides spacing between the face plate 110 and the backing plate 130. This spacing gives the projectile 350 time to change direction before impacting the backing plate 130. The larger the spacing between plates 110 and 130, the more opportunity the projectile 350 has to change course, so that the projectile 350 contacts the backing plate 130 at a less effective striking angle $\beta$. The less effective striking angle $\beta$ is an angle less than 90°. The closer the less effective striking angle $\beta$ is to 0°, the easier it is for the hard composite backing plate 130 to stop or deflect the projectile 350. In embodiments in which the intermediate module 120 is a foam structure or a honeycomb structure, the bulk of the intermediate module 120 may also impede the travel of the projectile 350, which also reduces the force of the impact on the backing plate 130. FIG. 3 shows the projectile 350 completely arrested in the backing plate 130, thereby protecting the surface 200 from damage. In one embodiment, the backing plate 130 may act in conjunction with the surface 200 to deflect or to stop the projectile. Therefore according to this embodiment, when the surface 200 is a surface of a water vessel, the backing plate 130 and the surface 200 combine to form a layered arrangement that protects the water vessel from damage.

Figure 4:
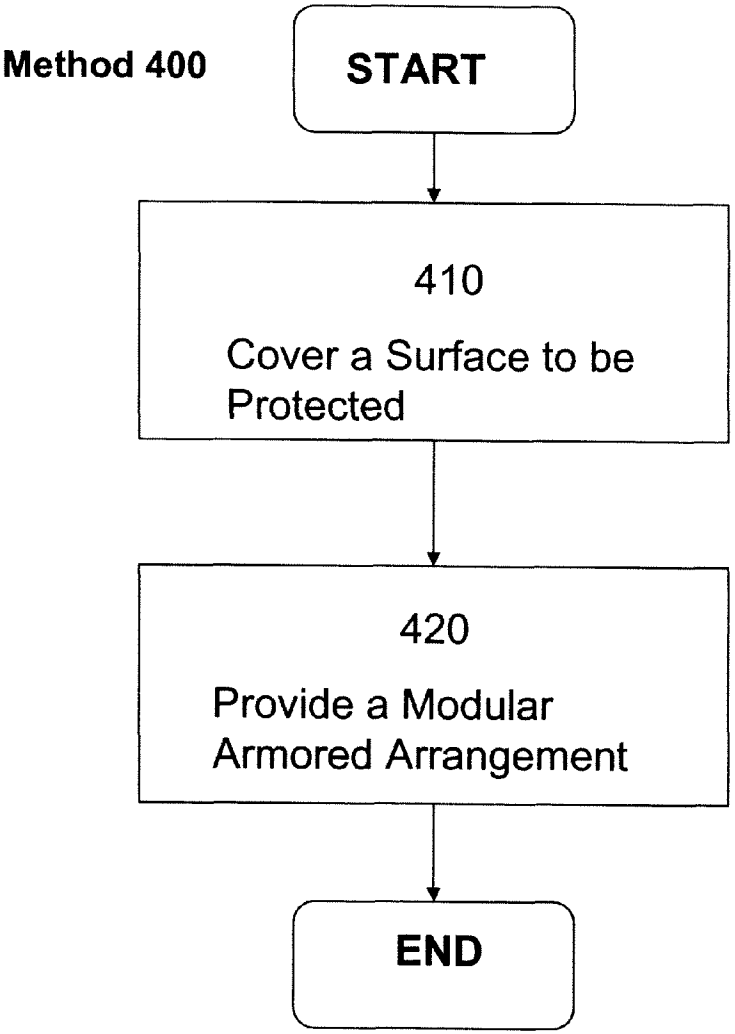
FIG. 4 is a flowchart illustrating a method of protecting a surface according to an embodiment of the invention.

FIG. 4 is a flowchart illustrating a method 400 of protecting a surface 200 according to an embodiment of the invention. The steps involved in the method 400 of protecting a surface have been outlined above in detail in the description of FIGS. 1-3. Step 410 is the covering of the surface 200 with a modular armored arrangement (101, 102, and 103). As outlined above, the armored arrangement protects the surface 200 from explosives, projectiles and the like. The surface 200 may be any surface that is to be protected. According to an embodiment of the invention, the surface 200 is an external surface of a combat vehicle such as a tank, an armored car, an amphibious landing vehicle, a littoral combat ship, a patrol boat, a combat boat, or the like.

Step 420 is the providing of the modular armored arrangement (101, 102, and 103) with a plurality of interchangeable modular spaced armor assemblies 100. As outlined above, in arrangements 101, 102, and 103, the individual modular assemblies 100 are arranged in a side-by-side manner on the surface 200. As outlined above, each modular armor assembly 100 of the arrangement may be rectangular, triangular, pentagonal, hexagonal, octagonal, or irregular. Each modular assembly 100 includes a first plate 110, a lightweight low-density intermediate module 120, and a second backing plate 130 as shown in FIG. 1.

What has been described and illustrated herein are preferred embodiments of the invention along with some variations. The terms, descriptions and figures used herein are set forth by way of illustration only and are not meant as limitations. For example, spaced armor assemblies as outlined above, may also be used as body armor. Those skilled in the art will recognize that many variations are possible within the spirit and scope of the invention, which is intended to be defined by the following claims and their equivalents, in which all terms are meant in their broadest reasonable sense unless otherwise indicated

What is claimed is:

1. A modular spaced armor assembly comprising: a ceramic face plate having an exposed upper surface; a composite backing plate having an exposed bottom surface; a lightweight low-density module between the ceramic face plate and the composite backing plate, the lightweight low-density module being directly bonded to and abutting each of the ceramic face plate and the composite backing plate, wherein the lightweight low-density module is a foam material having one or more gas-filled cavities, wherein the gas comprises at least 30% of the volume of the lightweight low-density module; one or more compressible encapsulation plates forming a continuous band surrounding the ceramic face plate the composite backing plate and the lightweight low-density module, exposing only the upper surface of the ceramic face plate and the bottom surface of the composite backing plate, wherein the ratio of the thickness of the ceramic face plate to the thickness of the lightweight low-density module is about 1 to 10 to about 1 to 25, and wherein the ratio of the thickness of the composite backing plate to the thickness of the lightweight low-density module is about 1 to 20 to about 1 to 50.

2. The modular spaced armor assembly of claim 1, wherein the assembly has a triangular, rectangular, pentagonal, or hexagonal shape.

3. The modular spaced armor assembly of claim 2, wherein each of the ceramic face plate and the composite backing plate comprises multiple layers.

4. The modular spaced armor assembly of claim 3, wherein the lightweight low-density module is completely gas-filled.

5. A modular armored arrangement comprising:

a protected surface;

a plurality of modular spaced armor assemblies positioned on the protected surface, each modular spaced armor assembly comprising:

a ceramic face plate having an exposed upper surface; a composite backing plate having an exposed bottom surface attached to the protected surface;

a lightweight low-density module between the ceramic face plate and the composite backing plate, the lightweight low-density module being directly bonded to and abutting each of the ceramic face plate and the composite backing plate, wherein the lightweight low-density module is a foam material having one or more gas-filled cavities, wherein the gas comprises at least 30% of the volume of the lightweight low-density module;

one or more compressible encapsulation plates forming a continuous band surrounding the ceramic face plate the composite backing plate and the lightweight low-density module, exposing only the upper surface of the ceramic face plate and the bottom surface of the composite backing plate, wherein the ratio of the thickness of the ceramic face plate to the thickness of the lightweight low-density module is about 1 to 10 to about 1 to 25, and wherein the ratio of the thickness of the composite backing plate to the thickness of the lightweight low-density module is about 1 to 20 to about 1 to 50.

6. The modular armored arrangement of claim 5, wherein the plurality of modular spaced armor assemblies form a tiled pattern on the protected surface, wherein an encapsulation plate of one modular spaced armor assembly of the plurality of modular spaced armor assemblies abuts and is compressed against an encapsulation plate of another modular spaced assembly of the plurality of spaced modular assemblies, thereby each modular spaced armor assembly is in a compressed relation with respect to an adjacent abutting modular spaced armor assembly, thereby creating a clamping force that holds the modular armored arrangement together.

7. The modular armored arrangement of claim 6, wherein each of the plurality of modular spaced armor assemblies has a triangular, rectangular, pentagonal, or hexagonal shape.

8. The modular armored arrangement of claim 7, wherein in each of the plurality of modular spaced armor assemblies, the lightweight low-density module is entirely gas-filled.

9. The modular armored arrangement of claim 7, wherein the protected surface is a surface of a combat vehicle.

10. A modular spaced armor assembly comprising: a ceramic face plate having an exposed upper surface; a composite backing plate having an exposed bottom surface; a lightweight low-density module between the ceramic face plate and the composite backing plate, the lightweight low-density module being directly bonded to and abutting each of the ceramic face plate and the composite backing plate, wherein the lightweight low-density module is a honeycomb material having one or more gas-filled cavities, wherein the gas comprises at least 30% of the volume of the lightweight low-density module; one or more compressible encapsulation plates forming a continuous band surrounding the ceramic face plate the composite backing plate and the lightweight low-density module, exposing only the upper surface of the ceramic face plate and the bottom surface of the composite backing plate, wherein the ratio of the thickness of the ceramic face plate to the thickness of the lightweight low-density module is about 1 to 10 to about 1 to 25, and wherein the ratio of the thickness of the composite backing plate to the thickness of the lightweight low-density module is about 1 to 20 to about 1 to 50.

* * * * *